US007258203B2

(12) United States Patent
De Jong et al.

(10) Patent No.: US 7,258,203 B2
(45) Date of Patent: Aug. 21, 2007

(54) METHOD FOR CONTROLLING THE ELEVATORS IN AN ELEVATOR GROUP

(75) Inventors: Johannes De Jong, Järvenpää (FI); Pentti Laihanen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/583,158

(22) Filed: Oct. 19, 2006

(65) Prior Publication Data

US 2007/0080027 A1 Apr. 12, 2007

Related U.S. Application Data

(63) Continuation of application No. PCT/FI2004/000246, filed on Apr. 22, 2004.

(30) Foreign Application Priority Data

Jan. 31, 2003 (FI) ..... 20030147

(51) Int. Cl.
*B66B 1/20* (2006.01)

(52) U.S. Cl. ..... 187/383; 187/388

(58) Field of Classification Search ..... 187/380–389, 187/247, 248

See application file for complete search history.

(56) References Cited

U.S. PATENT DOCUMENTS

| | | | | |
|---|---|---|---|---|
| 5,022,497 | A * | 6/1991 | Thanagavelu | 187/382 |
| 5,719,360 | A * | 2/1998 | Davis et al. | 187/383 |
| 6,991,068 | B2 * | 1/2006 | Siikonen et al. | 187/383 |
| 7,117,980 | B2 * | 10/2006 | Wyss et al. | 187/383 |

FOREIGN PATENT DOCUMENTS

| | | |
|---|---|---|
| EP | 1 270 486 A | 1/2003 |
| JP | 6-072646 A | 3/1994 |
| JP | 2002-154753 A | 5/2002 |

* cited by examiner

*Primary Examiner*—Jonathan Salata
(74) *Attorney, Agent, or Firm*—Birch, Stewart, Kolasch & Birch, LLP

(57) ABSTRACT

The present invention relates to a method for controlling the elevators of an elevator group in a building divided into zones comprising different floors in such manner that, at the passenger's departure floor, the elevators are given calls to floors beyond the zone limits of the departure zone. According to the invention, the aforesaid call is divided into two or more calls.

15 Claims, 8 Drawing Sheets

METHOD FOR CONTROLLING THE ELEVATORS IN AN ELEVATOR GROUP

Figure 1:
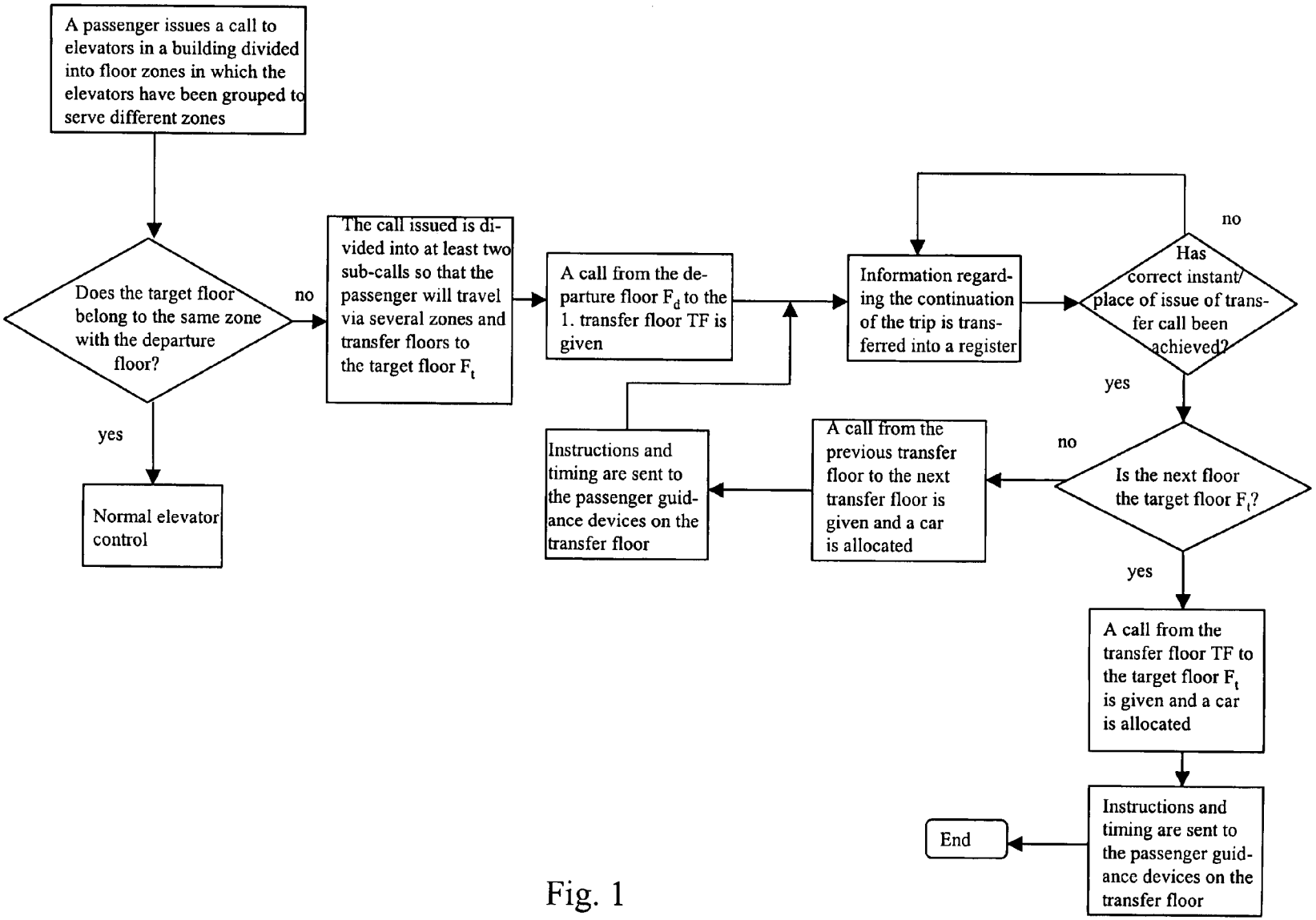

This application is a Continuation of copending PCT International Application No. PCT/FI2004/000246 filed on Apr. 22, 2004, which designated the United States, and on which priority is claimed under 35 U.S.C. § 120. The entire contents of each of the above documents is hereby incorporated by reference.

The present invention relates to a method as defined in the preamble of claim 1 for controlling the elevators in an elevator group.

Prior-art technology is described in U.S. patent specification U.S. Pat. No. 5,719,360 (B66B 1/18), which discloses an elevator group comprising several elevators, wherein the elevator cars serve selected floors in the building, some of the elevator cars being grouped to serve the lower floors of the building while the rest of the elevator cars are grouped to serve the upper floors of the building. The elevator group described here comprises several transfer floors, the location of which is selectable. On a transfer floor, the passenger changes elevators when traveling from the lower floors to the upper floors and vice versa.

Published EP application 1270486 (B66B 1/20) discloses a prior-art method for selecting favorable elevators when a passenger changes elevator cars from one elevator group to another while traveling from a departure floor to a destination floor. In this method, the journey from the departure floor to the destination floor is divided into several sub-trips via transfer floors so that the passenger travels between transfer floors on elevators belonging to different elevator groups and these elevator groups are controlled by higher-level control systems.

In the case of the published EP application, several elevator groups are controlled by a higher-level control system ranked above these elevator groups in respect of control hierarchy, with an aim to control and prevent elevator congestion at the transfer floors.

In principle, in elevator group control it is possible to assign two elevator cars to one call in such manner that one of them serves the lower floors of the building and the other serves the upper floors of the building. In this case, the floors of the building have been divided into zones such that the upper floors of the building belong to a separate zone while the lower floors of the building belong to another separate zone. The above-mentioned two zones may overlap each other preferably by one or more floors, in which case this floor or these floors belonging to both zones can be utilized to allow a passenger wanting to travel from one zone to the other to transfer from an elevator serving the zone of the departure floor to an elevator serving the destination floor. Such a floor is called a transfer floor or change floor.

As is known, destination control of an elevator group also allows two elevator cars to be assigned to one destination call so that one of them serves the lower floors of the building and the other one serves the upper floors of the building in a building divided into two zones.

Destination control of an elevator group again refers to a call input arrangement in an elevator group wherein, using destination call input devices designed for this purpose in the elevator passenger's departure lobby, a destination call comprising both an elevator call to the landing and an elevator call to the destination floor is issued to the elevators. In this case, no car call input devices are provided in the elevator car at all.

As is known, the elevators in an elevator group can also be controlled by a so-called hybrid control arrangement, which refers to a combination of destination call input and conventional car call input such that the passenger can give the elevator a call to a desired destination floor using either conventional landing and car call input devices or destination call input devices placed at the landing. When the conventional landing and car call input devices are used and calls to floors beyond the departure zone are given, a floor call issued from a car is divided into parts.

In a normal elevator call input arrangement, a passenger wanting to enter an elevator calls an elevator to the landing by using conventional up/down call buttons, pressing the down call button if he wants to have a downward ride on the elevator and the up call button if he wants to have an upward ride on the elevator. Next, having entered the car, the passenger selects in the car the final destination floor that he wants to reach. In this case of normal elevator call input arrangement, it is also possible in a building comprising different zones for passengers to give calls to floors beyond the departure zone, in which case the call issued from the car is divided into parts.

In the present context, building refers to all types of above-ground buildings, water-borne vessels, unfinished buildings under construction, or the like.

Allocation in this context refers to both input, division, reservation or assignment of a call.

The main problem in prior-art solutions is that passengers' traveling times and the times required for transferring from an elevator coming from the departure floor of the departure zone to another elevator going to the destination floor in the destination zone as well as the waiting times become too long, which has an adverse effect on the accuracy of allocation of the elevators of the elevator group.

The time elapsing between the initial call input and the arrival at the destination floor is too long when during an elevator trip the passenger has to pass via a transfer floor where the passenger must go to a call input device to issue a further call to the next floor. In such a situation, congestion builds up on the transfer floors and the passengers have to wait there unnecessarily long for the next elevator going to the destination floor and the destination zone.

Typically, such an undesirable situation occurs e.g. when, as a passenger has to transfer from one zone to another during an elevator trip, the group control system of the elevators changes the transfer floor according to capacity, which is the procedure observed in the case of the prior-art U.S. Pat. No. 5,719,360.

A further problem is that, due to insufficient guidance, a passenger trying to find an elevator on the transfer floor does not necessarily find quickly and easily an elevator going to his final destination floor, which is another factor increasing the passenger's total journey time.

The object of the present invention is to overcome the drawbacks appearing in the above-described prior-art technology. The object of the present invention is to shorten elevator allocation time and to enable correct allocation decisions to be made in group control so as to achieve a good predictability and accuracy. According to the present invention, the solution here is to delay secondary elevator calls.

In more accurate terms, the method of the invention for controlling the elevators of an elevator group is characterized by what is disclosed in the characterization part of claim 1. The features of certain preferred embodiments of the invention are disclosed in the sub-claims.

As compared with prior art, the method of the invention provides significant advantages.

According to the method of the invention for controlling the elevators in an elevator group, the greatest advantage achieved is that by dividing elevator calls to floors beyond the zone limits of the departure floor into two or more sub-calls, a good predictability and accuracy of elevator control is achieved, enabling the elevator group control system to make elevator allocation and transfer floor assignment decisions as correct as possible while at the same time minimizing passenger transfer times on the transfer floors as well as the total journey time. The longer the allocation of an elevator can be delayed by delaying the allocation decision when the elevator is approaching a transfer floor, the more efficient elevator operation will be achieved.

The present invention provides a further advantage in that congestion and therefore also the numbers of passengers waiting for elevators on the transfer floors are reduced, which again makes it possible to have smaller transfer floors and/or spaces reserved for elevator lobby use in the building. This allows the spaces freed up from lobby use to be utilized for other purposes, so the owner of the building may be able to get more rental income or make better rental agreements.

Another advantage provided by the present invention is a more flexible function of the building as the building parts situated in different zones in respect of traffic are interconnected. Thus, the owner of the building will find it easier to rent out spaces divided between two zones in the building.

According to the present invention, the floor of transfer from a departure zone elevator to a destination zone elevator is assigned according to the load factor of or a forecast number of persons on the possible transfer floors.

As an additional advantage, as compared to prior art, the present invention significantly reduces the total journey times of passengers using the elevators.

The present invention concerns a method for controlling the elevators of an elevator group in a building divided into zones comprising different floors in such manner that, on the passenger's departure floor, the elevators are given calls to floors beyond the zone limits of the departure zone. According to the most preferred embodiment of the present invention, the aforesaid call is divided into at least two divided calls such that the passenger will travel via several zones and transfer floors to the destination floor, the allocation of the call for the latter portion of the journey being delayed as compared to the allocation of the call for the first portion of the journey.

According to another embodiment of the present invention, the divided call for the aforesaid latter portion of the journey is allocated later, preferably not until the passenger is temporally close to a transfer floor on his/her journey to be served by a subsequent zone.

According to another embodiment of the present invention, the divided call for the aforesaid latter portion of the journey is allocated to the next transfer floor or the destination floor when the passenger is on the aforesaid transfer floor.

According to a different embodiment of the present invention, the divided call for the aforesaid latter portion of the journey is allocated to the next transfer floor or the destination floor when the passenger is coming temporally relatively close to the aforesaid next transfer floor in comparison with the total travel time of the elevator allocated to the passenger at the departure floor or at the previous transfer floor.

According to the present invention, a change between elevators of the elevator group serving different zones is preferably performed on a transfer floor which is selected in the elevator group control from several predetermined transfer floors overlapping with one or more different zones by one or more floors.

According to another embodiment of the invention, the aforesaid transfer floor is selected in the group control from among predetermined transfer floors on the basis of the load factor so that the number of passengers on the transfer floors is minimized.

Further, according to another embodiment of the invention, the aforesaid transfer floor is selected in the group control from among certain possible transfer floors by adaptively varying the number of transfer floors and/or the limits of the transfer floor zone on the basis of the load factor of the transfer floors. According to yet another embodiment of the invention, the aforesaid transfer floor is preferably selected in the group control during the travel of the elevator car allocated to the passenger from the departure floor.

According to the present invention, the aforesaid call to a floor beyond the zone limits of the departure zone is preferably divided into as many calls as the passenger has zones to pass through from the departure floor to the destination floor in such manner that the first call is given from the departure floor to an intermediary transfer floor and a first car is allocated to the passenger and one or more next calls are given from the previous intermediary transfer floor to the next intermediary transfer floor and a car is allocated to the passenger in such manner that the last call is given from the last intermediary transfer floor to the destination floor and a car is allocated to the passenger.

According to still another embodiment of the invention, the aforesaid call to a floor beyond the zone limits of the departure zone is divided into two calls in such manner that the first call is given from the departure floor to a transfer floor and a first car is allocated to the aforesaid passenger and the second call is given from the aforesaid transfer floor to the destination floor and a second car going to the destination floor is allocated to the passenger.

According to a preferred embodiment of the present invention, the passenger is guided on the transfer floor by means of car-specific and/or elevator-specific and/or lobby-specific passenger guiding devices to elevators allocated from there to the destination floor or intermediary transfer floors.

According to another embodiment of the present invention, displays serving as passenger guiding devices are placed either in the upper part of the elevator car or in the elevator lobby in front of the elevator arriving at the transfer floor or outside the elevator lobby on the transfer floor.

According to the present invention, in a building divided into zones, the elevators are preferably controlled in such manner that each zone is controlled as a separate elevator group by a separate group control system and each group control system controlling a zone is controlled in common by a coordinating elevator group management control system, which divides the aforesaid zone-specific elevator groups into classes.

According to the present invention, the call to a floor beyond the zone limits of the departure zone given to the elevators of the elevator group at the departure floor is given as a destination floor call by means of a destination floor call input device in the elevator lobby. According to yet another embodiment of the invention, the call to a floor beyond the zone limits of the departure zone given to the elevators of the elevator group at the departure floor is given as a hybrid call or as a car call beyond the zone.

According to a preferred embodiment of the present invention, when a call is given to the elevators at the departure floor, a check is always made to establish whether the departure floor belongs to the same zone as the destination floor.

Figure 2A:
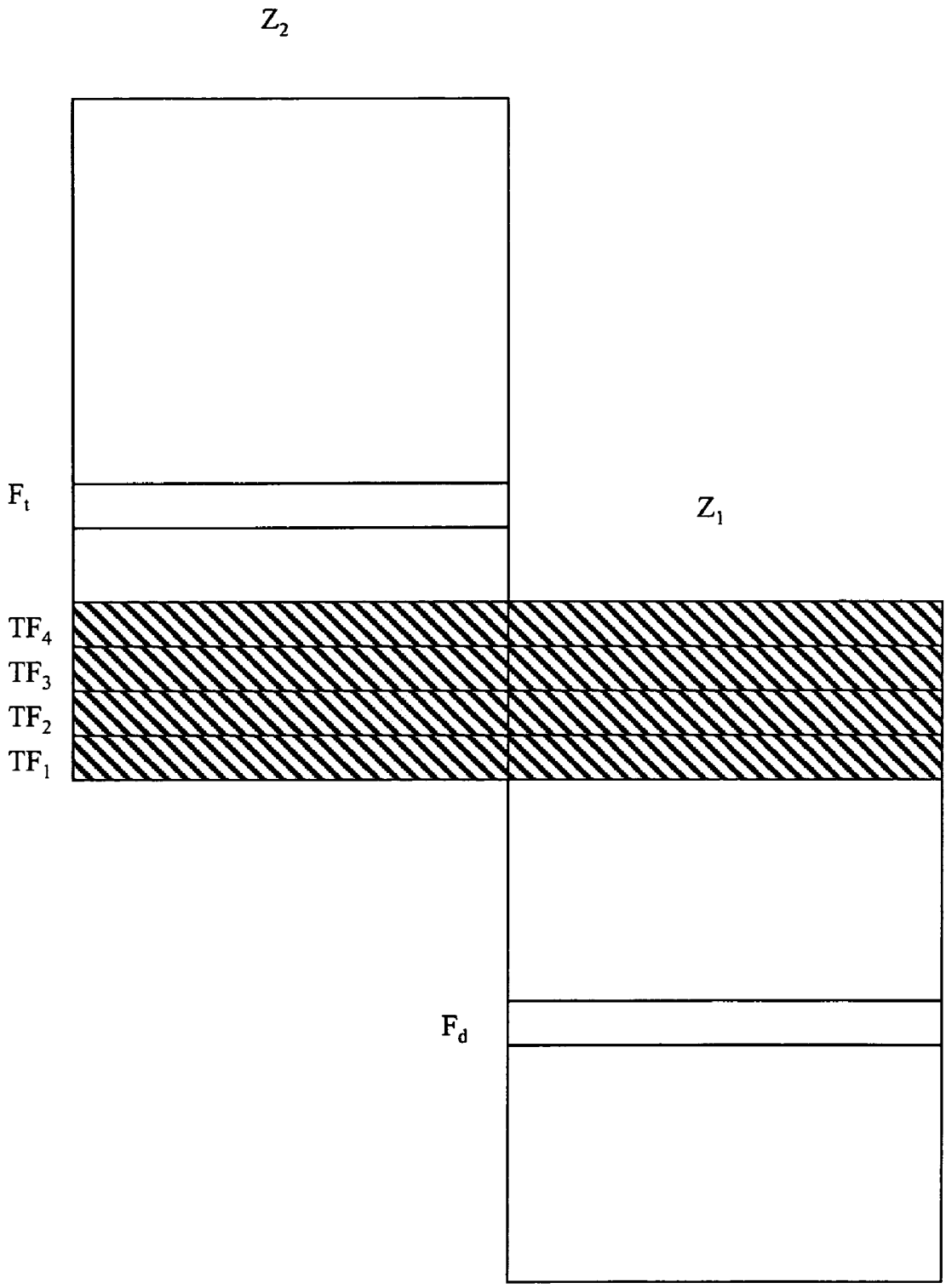
Figure 2B:
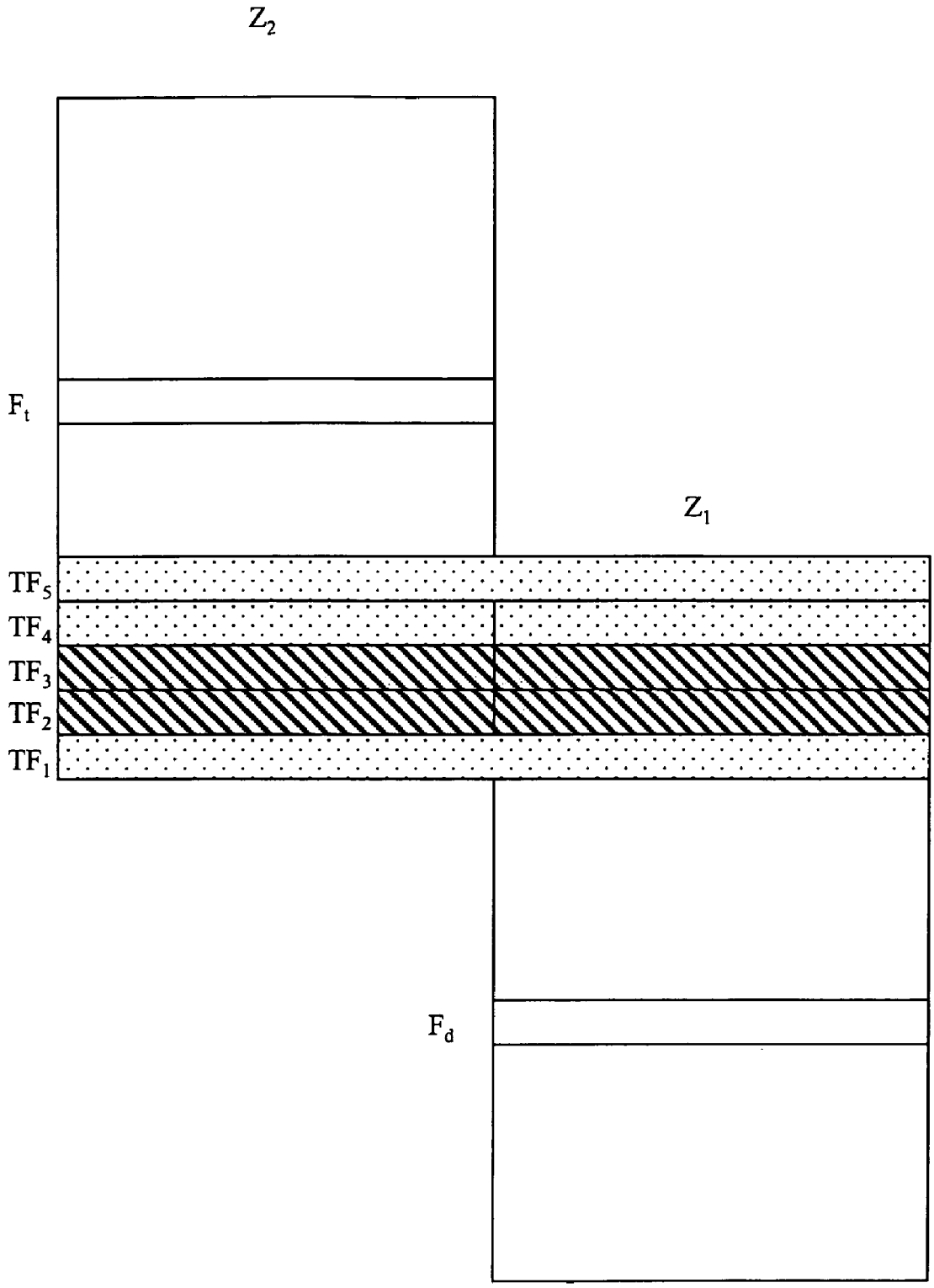
Figure 2C:
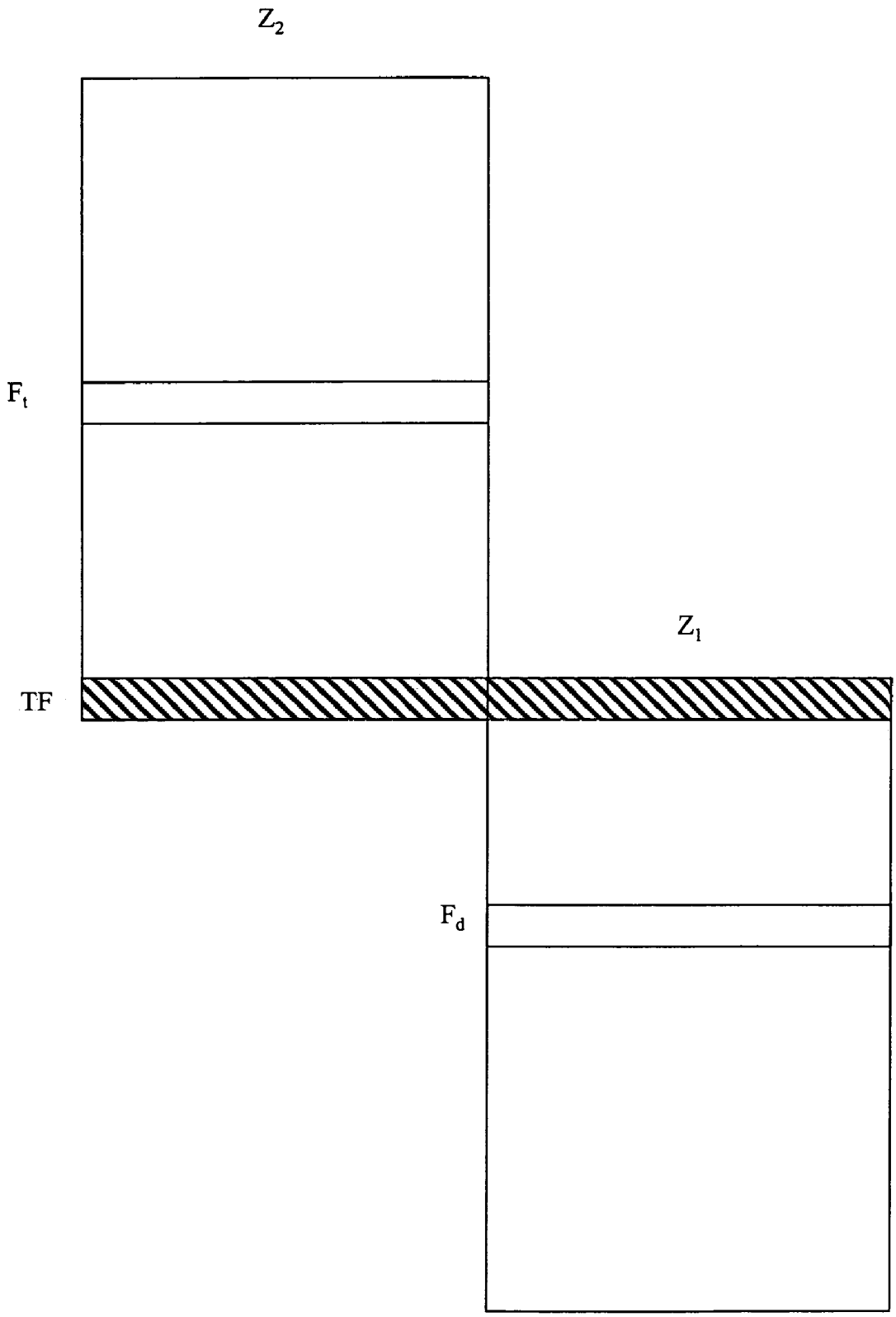
Figure 2D:
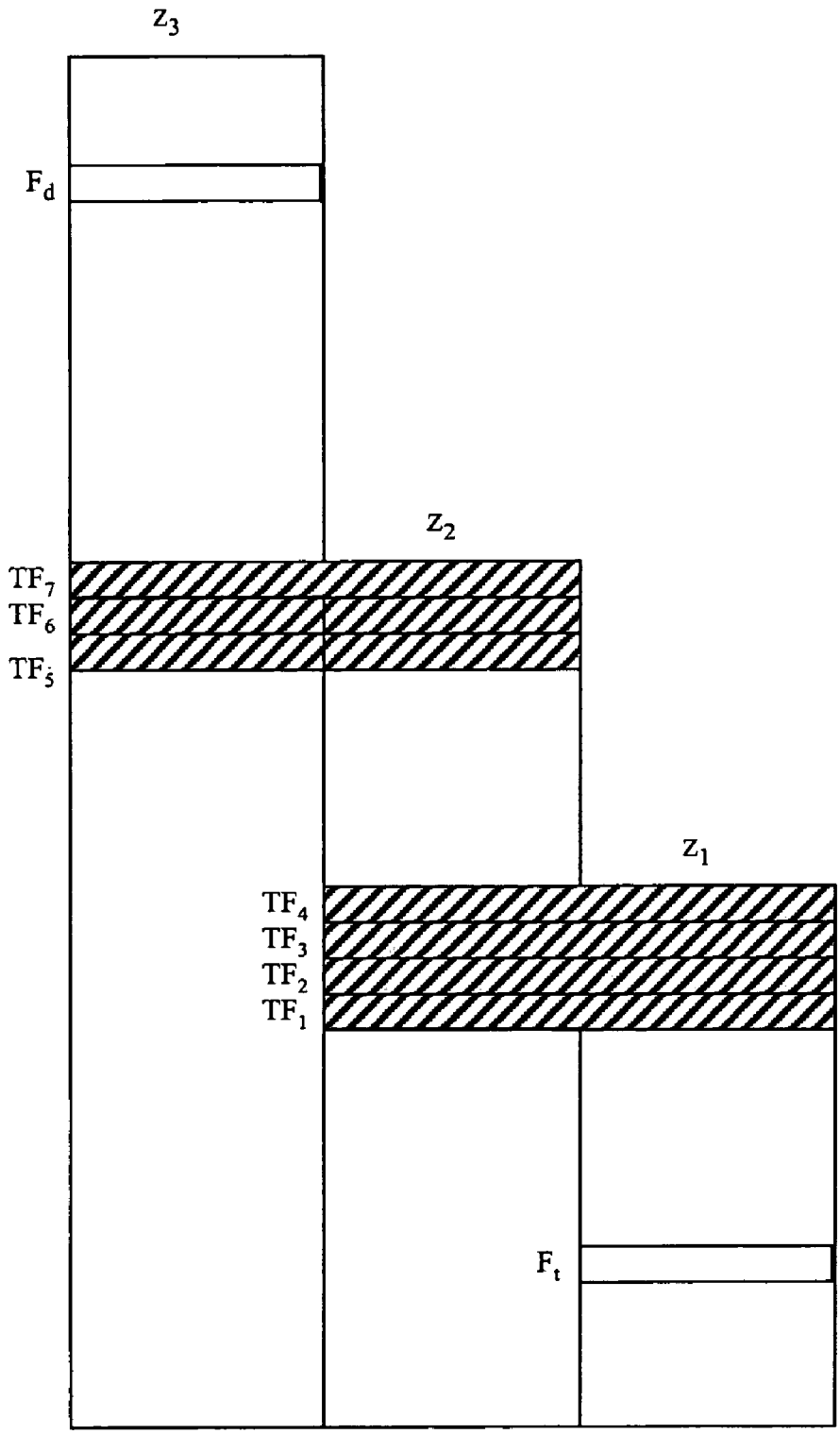
Figure 2E:
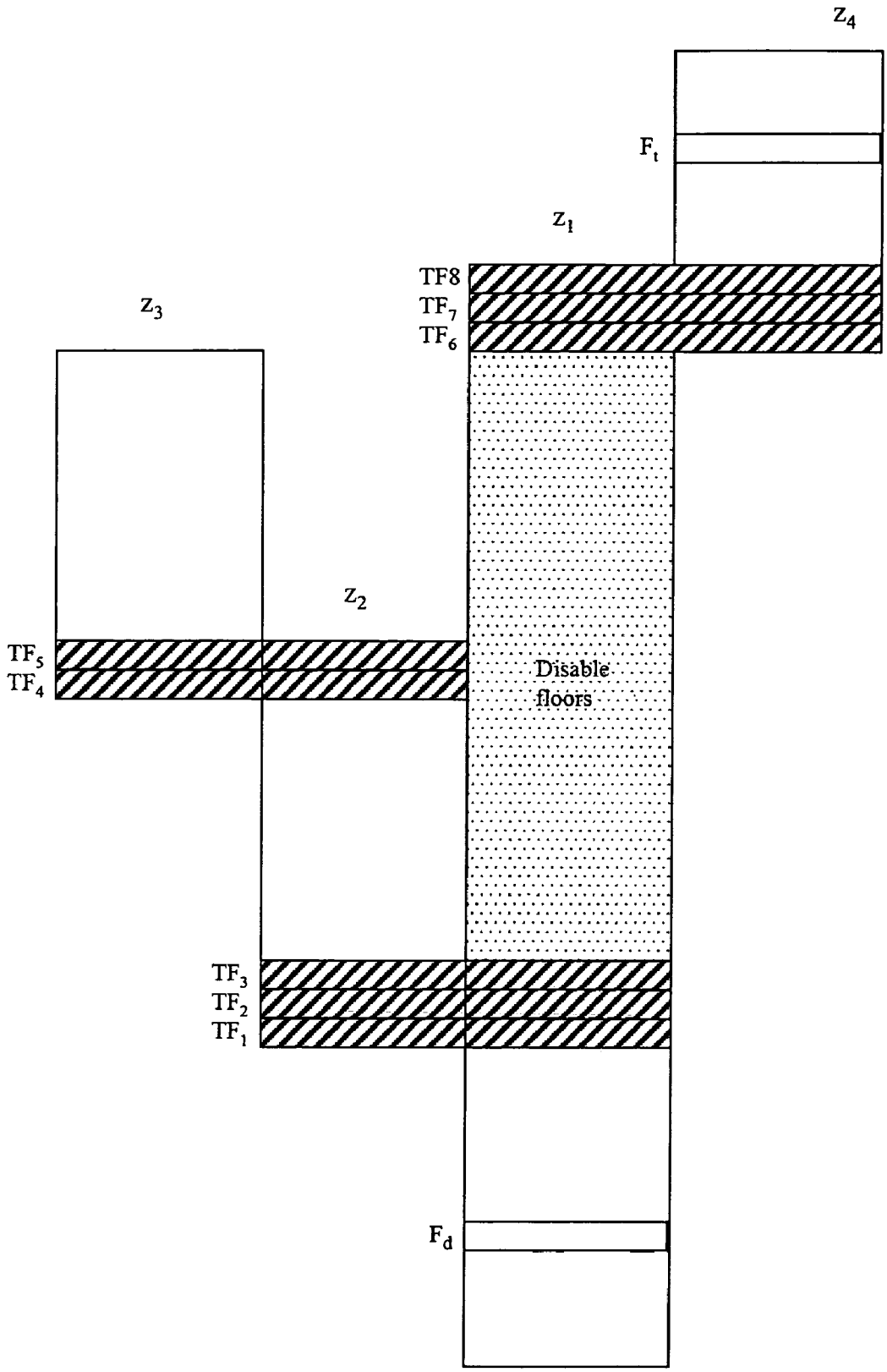
Figure 2F:
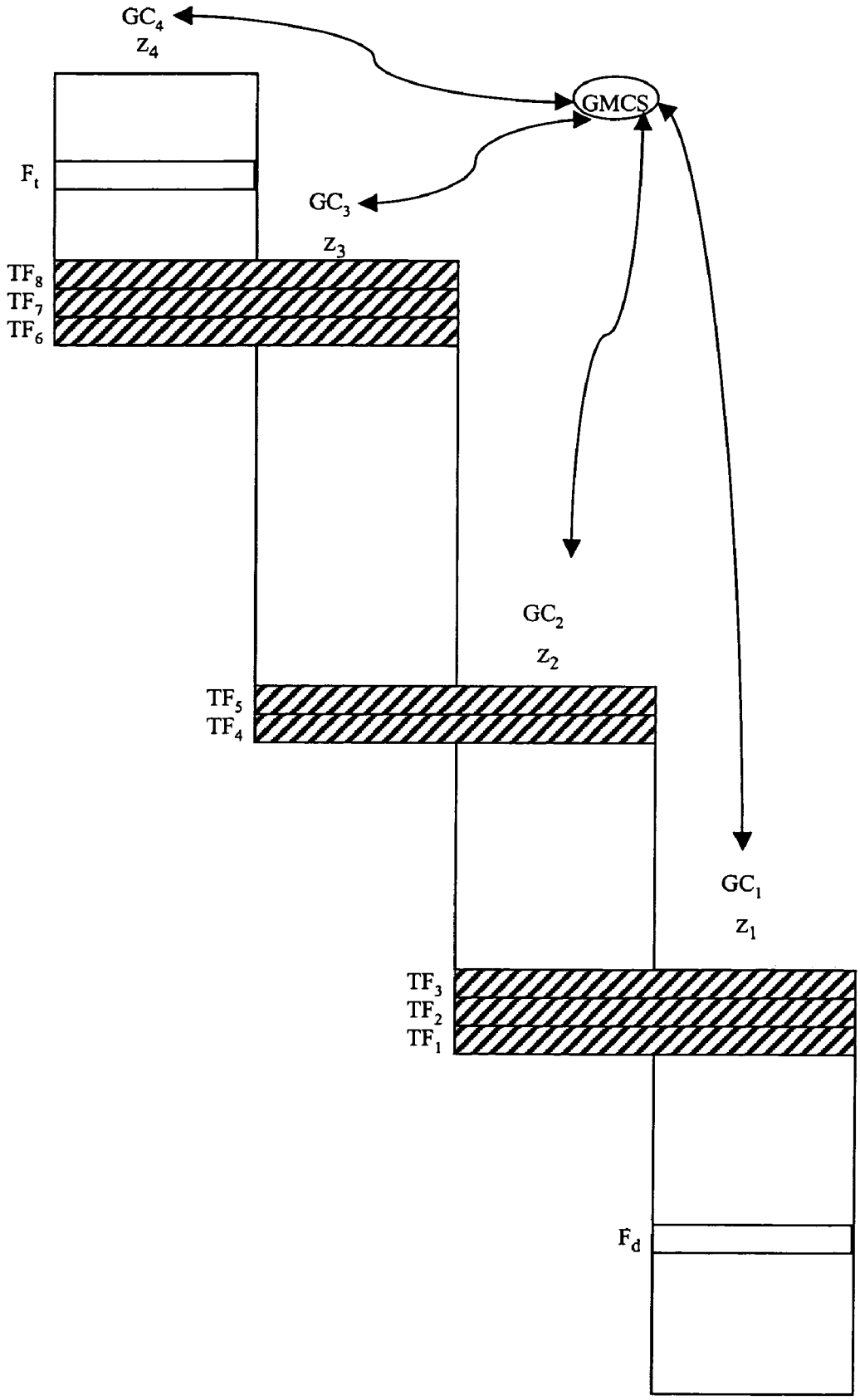
Figure 3:
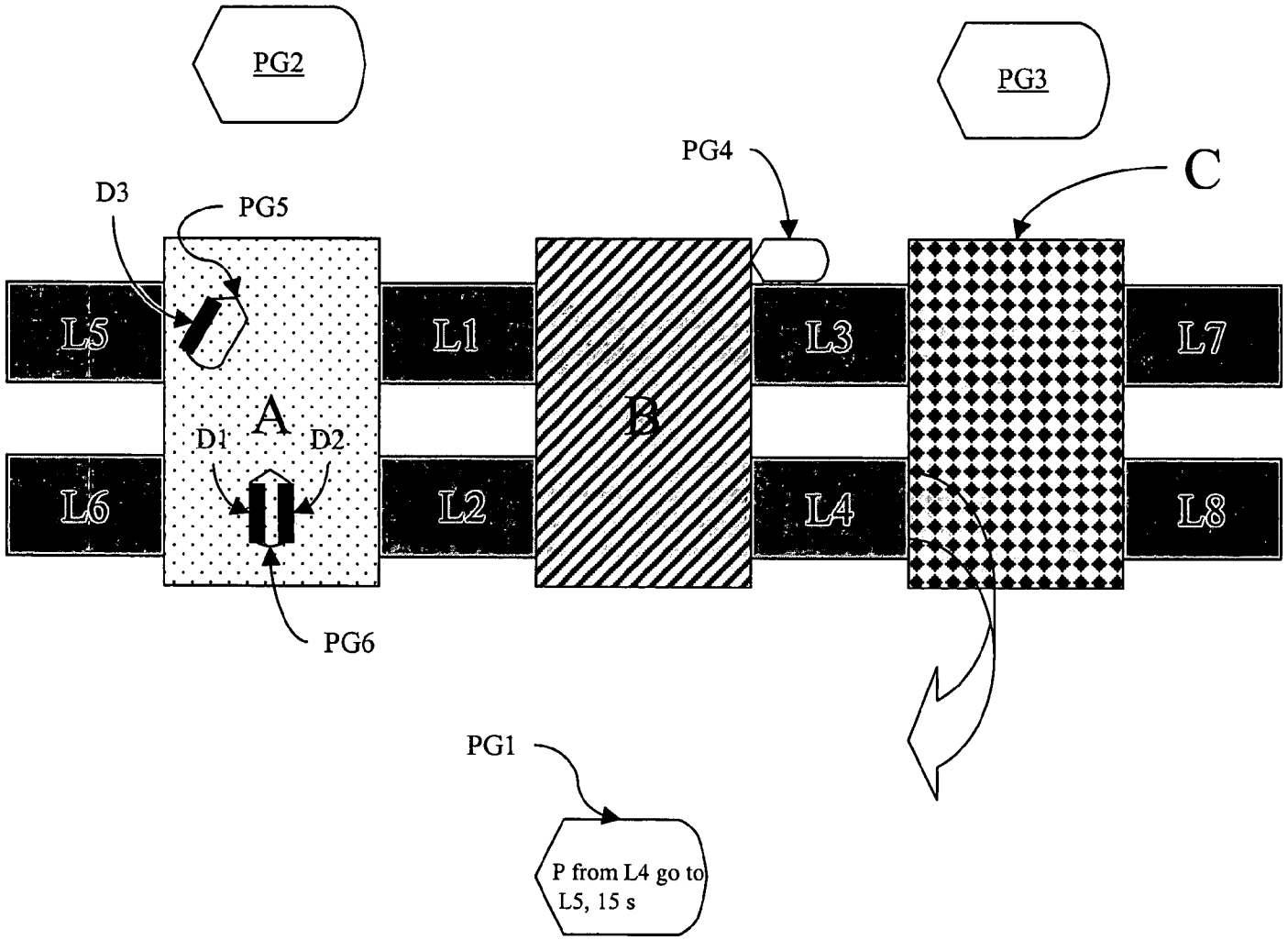

In the following, the invention will be described in detail with reference to an example and the attached drawings, wherein FIG. 1 presents a general diagram representing the method of the invention, FIG. 2A represents the most preferred embodiment of the present invention, FIG. 2B represents another embodiment according to the invention, FIG. 2C represents a third embodiment according to the invention, FIG. 2D represents an alternative embodiment according to the invention, FIG. 2E represents another alternative embodiment according to the invention, FIG. 2F represents an embodiment of the invention wherein each different zone is controlled by a separate group control system, FIG. 3 presents a plan drawing of the layout of elevators, floor lobbies and passenger guidance devices on a transfer floor, In FIG. 1, the method of the present invention is visualized by a block diagram.

The present invention concerns a method for controlling the elevators of an elevator group in a building divided into zones comprising different floors in such manner that, on the passenger's departure floor, the elevators are given calls to floors beyond the zone limits of the departure zone.

According to the most preferred embodiment of the present invention, the aforesaid call is divided into several calls in such manner that the passenger will travel through several zones and transfer floors to the destination floor so that the allocation of the call for the latter portion of the trip is delayed as compared to the allocation of the call for the first portion of the trip.

When a call is given to the elevators at the departure floor, a check is always made to establish whether the departure floor belongs to the same zone as the destination floor. If the call is not to a floor beyond the zone limits, the call will be processed in accordance with normal group control of the elevators.

If the building has been divided into several zones served by different elevators from the same or different elevator groups and if on the departure floor $F_d$ a call to a destination floor $F_t$ outside the departure zone is given, then the call is divided into several, at least two parts in such manner that the first call is given from the departure floor $F_d$ to a transfer floor TF. This division of the call can be advantageously performed by dividing the whole call at once into parts that comprise both a call given from the departure floor $F_d$ to a first transfer floor TF and one or more calls for subsequent portions of the trip. Another advantageous procedure is to divide the call into parts in such manner that the first part comprises a call from the departure floor $F_d$ to the first transfer floor TF and the second part comprises all other calls pertaining to subsequent portions of the trip, which are divided later in different periods so that when the next call is divided, the number of remaining calls decreases.

After this division of the call, according to the method of the invention, information regarding the continuation of the trip is transferred into a register. Next, a check is carried out to determine whether a relatively correct instant of time of issue of the transfer call and a relatively correct place of issue of the transfer call in the elevator system or shaft have been achieved as compared to the total journey time from the departure floor to the transfer floor. If the result is in the negative, then the procedure is resumed from the preceding step.

If a relatively correct instant of time of issue of the transfer call or a relatively correct place of issue of the transfer call has been achieved but the next floor is not the target floor $F_t$, a call is again given from the previous transfer floor to the next transfer floor and a car is allocated to the passenger. After this, instructions and timing as to how the passenger having reached the transfer floor will find his/her way to an elevator going to the next transfer floor are sent to the passenger guidance devices on the transfer floor, whereupon the information concerning the continuation of the trip is transferred into a register. Next, a test is again carried out to determine whether the correct time/place of the transfer call has been achieved. If the result of the aforesaid test is positive, a test is carried out to determine whether the next floor is the target floor $F_t$, and so on. This process is continued until the passenger has reached the target floor $F_t$.

However, without limiting the invention in any way, it is possible to apply the present inventive method when the control of the elevators is implemented using either destination control or hybrid control or normal control.

FIGS. 2A-2F visualize alternative embodiments of the present invention.

FIG. 2A visualizes the most preferred embodiment according to the invention, wherein the building has been divided into two zones $Z_1$ and $Z_2$. Of these zones, $Z_1$ serves the lower floors of the building and $Z_2$ serves the upper floors of the building.

In the situation visualized in this figure, the passenger gives calls to the elevators while on his departure floor $F_d$ when he/she wants to travel to a destination floor $F_t$ which does not belong to the same zone with the departure floor. In other words, in this case, the elevators are given calls at the passenger's departure floor to floors beyond the zone limits of the departure zone. The passenger preferably gives the elevators a destination call as described above, which comprises an elevator call both to the departure floor $F_d$ and to the target floor $F_t$ of the elevator. The call to a floor beyond the zone limits of the departure zone issued on the departure floor to the elevators of the elevator group is preferably given as a destination floor call by means of a destination call input device provided in the elevator lobby. However, without restricting the invention in any way, according to an embodiment according to the invention, a call to a floor beyond the zone limits of the departure zone can be given to the elevators on the departure floor of the departure zone as a hybrid call beyond the zone in such manner that the call is divided into parts.

According to the present invention, the call to a floor beyond the zone limits of the departure zone is divided into at least two calls in such manner that the first call is given from the departure floor $F_d$ to a transfer floor $TF_1$, $TF_2$, $TF_3$, $TF_4$, and a first car is allocated to the passenger, and the second call is given from the aforesaid $TF_1$, $TF_2$, $TF_3$, $TF_4$, to the target floor $F_t$ and a second car to the target floor $F_t$ is allocated to the aforesaid passenger.

In the case illustrated in FIG. 2A, it is possible for the group control system of the elevator group to select from among the four transfer floors $TF_1$, $TF_2$, $TF_3$, $TF_4$ the transfer floor which is selected in group control from among predetermined transfer floors on the basis of the load factor so as to minimize the number of passengers on the transfer floors $TF_1$, $TF_2$, $TF_3$, $TF_4$, which are mutually alternative. In this case, the first elevator allocated to the passenger stops at a transfer floor $TF_1$, $TF_2$, $TF_3$, $TF_4$ selected by the group control system and an elevator is allocated for the passenger which will take the passenger to the target floor $F_t$.

According to an embodiment of the invention, the transfer floor $TF_1$, $TF_2$, $TF_3$, $TF_4$ is selected in the elevator group control system during the travel of the elevator car allocated to the passenger from the departure floor.

According to the present invention, the second call is preferably given from the aforesaid transfer floor $TF_1$, $TF_2$, $TF_3$, $TF_4$ to the target floor $F_t$ when the passenger comes temporally relatively close to the aforesaid transfer floor $TF_1$, $TF_2$, $TF_3$, $TF_4$ as compared to the total travel time of the elevator allocated to the passenger at the departure floor. The elevator allocated to the passenger at the departure floor together with its passengers has now come temporally relatively close to the transfer floor as compared to the total travel time of the elevator car from the departure floor to the transfer floor.

According to another alternative embodiment of the present invention, the aforesaid second call is given from the aforesaid transfer floor $TF_1$, $TF_2$, $TF_3$, $TF_4$ to the target floor $F_t$ while the passenger is on the aforesaid transfer floor $TF_1$, $TF_2$, $TF_3$, $TF_4$.

FIG. 2B presents an embodiment of the present invention wherein the transfer floor $TF_1$, $TF_2$, $TF_3$, $TF_4$, $TF_5$ is selected in the group control system from among certain possible transfer floors $TF_1$, $TF_2$, $TF_3$, $TF_4$, $TF_5$ by adaptively varying the number of transfer floors $TF_1$, $TF_2$, $TF_3$, $TF_4$, $TF_5$ and/or the limits of the transfer floor zone on the basis of the load factor of each transfer floor $TF_1$, $TF_2$, $TF_3$, $TF_4$, $TF_5$.

In the situation illustrated in FIG. 2B, the group control system of the elevator group can use a transfer floor zone consisting of only two transfer floors $TF_2$, $TF_3$ of the possible maximum number, i.e. five transfer floors $TF_1$, $TF_2$, $TF_3$ $TF_4$ $TF_5$. The fact that three $TF_1$, $TF_4$, $TF_5$ of the possible transfer floors are not in transfer floor use at a given moment may be due e.g. to a congested traffic situation in the elevator group when it has been found that three of the possible transfer floors have too high load factors. On the other hand, there may arise a situation where the floors in question are reserved for a use other than transfer floor use. Likewise, the group control system of the elevator group can exclude certain possible transfer floors from transfer floor use when a given condition is fulfilled.

FIG. 2C illustrates an embodiment of the invention wherein the zones $Z_1$ and $Z_2$ comprise only one possible transfer floor TF, where the passenger may change over to an elevator coming to the transfer floor TF from a departure floor $F_d$ in zone $Z_1$ and board an elevator going to the passenger's destination floor $F_t$ in zone $Z_2$.

FIG. 2D visualizes an embodiment of the invention wherein the building has been divided into more than two zones $Z_1$, $Z_2$ and $Z_3$, the number of zones being three in the situation illustrated in this figure.

According to this embodiment, the passenger changes between elevators serving different zones $Z_1$, $Z_2$, $Z_3$ of the elevator group on more than one intermediary transfer floors $TF_1$-$TF_7$ in order to reach a target floor $F_t$ outside the departure zone $Z_1$ given on the departure floor $F_d$ in the departure zone $Z_3$. This type of zoning is very favorable to the passenger expressly in a down-peak situation.

According to the embodiment of the invention presented in FIG. 2D, on the passenger's departure floor $F_d$, the elevators are given calls to floors beyond the zone limits of the departure zone $Z_3$ in such manner that the aforesaid call is divided into more than two calls. In this case, the first call is given from the departure floor $F_d$ to an intermediary transfer floor $TF_5$-$TF_7$ and a first car is allocated to the passenger, and one or more next calls are given from the previous transfer floor $TF_5$-$TF_7$ to the next transfer floor $TF_1$-$TF_4$ and a car is allocated to the passenger, so that the last call is given from the last intermediary transfer floor $TF_1$-$TF_4$ to the target floor $F_t$ and a car is allocated to the passenger.

FIG. 2E illustrates an embodiment of the invention wherein the building has been divided into several zones. According to this embodiment of the present invention, it is possible to transfer from an elevator serving zone $Z_1$ both to elevators serving zone $Z_2$ and to elevators serving zone $Z_4$. Passengers can transfer from elevators serving zone $Z_1$ to elevators serving zone $Z_4$ via three transfer floors $TF_6$, $TF_7$ and $TF_8$. To elevators serving zone $Z_2$, passengers can transfer from elevators serving $Z_1$ via three transfer floors $TF_1$, $TF_2$ and $TF_3$. Likewise, passengers can transfer from elevators serving zone $Z_2$ to elevators serving zone $Z_1$ via the three aforesaid transfer floors $TF_1$, $TF_2$ and $TF_3$. Between the above-mentioned transfer floors $TF_1$, $TF_2$ and $TF_3$ and transfer floors $TF_6$, $TF_7$ and $TF_8$ there are floors within zone $Z_1$ at which the elevators serving zone $Z_1$ do not stop at all.

A transfer from elevators serving zone $Z_2$ to elevators serving zone $Z_3$ is only possible via the two transfer floors $TF_4$ and $TF_5$. Likewise, passengers can transfer from elevators serving zone $Z_3$ to elevators serving zone $Z_2$ via the two aforesaid transfer floors $TF_4$ and $TF_5$. Thus, for example, passengers going from zone $Z_3$ to zone $Z_4$ will pass either via transfer floor $TF_4$ and $TF_5$ to elevators serving zone $Z_2$, from which they will transfer to elevators serving zone $Z_1$ on one of the aforesaid transfer floors $TF_1$, $TF_2$ and $TF_3$. From elevators serving zone $Z_1$, passengers can transfer to elevators serving zone $Z_4$ on one of transfer floors $TF_6$, $TF_7$ and $TF_8$.

In the case illustrated in FIG. 2E, the passenger travels from his/her departure floor $F_d$ to a target floor $F_t$ in zone $Z_4$ via transfer floors $TF_6$, $TF_7$ and $TF_8$. In this case, the passenger does not have to stop at transfer floors $TF_6$, $TF_7$ and $TF_8$ at all. Thus, the passenger's total journey time will be shorter than in the embodiment illustrated in FIG. 2D when the passenger's target floor $F_t$ is situated in a zone at a large distance from the zone of the departure floor $F_d$.

FIG. 2F illustrates an embodiment of the invention wherein each different zone $Z_1$-$Z_4$ is controlled by a separate group control system GC1-GC4, which again are controlled and managed by a coordinating higher-level control system, which in this context is referred to by the designation elevator group management control system GMCS.

According to this embodiment of the invention, in a building divided into zones, the elevators are controlled in such manner that each zone $Z_1$-$Z_4$ is controlled as a separate elevator group by a separate group control system GC1-GC4 and each group control system GC1-GC4 controlling a zone is controlled in common by a coordinating elevator group management control system GMCS, which divides the aforesaid zone-specific elevator groups into classes.

In all the above-mentioned embodiments visualizing the present invention, the passenger is guided by means of car-specific and/or elevator-specific and/or lobby-specific passenger guidance devices on the transfer floor to elevators allocated from there to the target floor or to intermediary transfer floors. Such passenger guidance devices are preferably displays, which are placed either in the upper part of the elevator car or in the elevator lobby in front of the elevator arriving at the transfer floor or outside the elevator lobby on the transfer floor. In addition, guide displays can be placed in the elevator lobby. From such guide displays, a passenger having arrived to a transfer floor on a given elevator will learn which elevator will take him/her either to the actual target floor or to the next transfer floor. As an option, the guide display may also display information showing which is the next elevator going to the target floor of a passenger having arrived at a transfer floor on a given elevator or to the next transfer floor in case the passenger will stay on the transfer floor longer than estimated.

FIG. 3 presents a plan drawing of the layout of the elevators, floor lobbies and passenger guidance devices PG1, PG2, PG3, PG4, PG5 and PG6 on a transfer floor. FIG. 3 shows an elevator group in which elevator cars L1, L2, L3 and L4 are two-door walk-through cars, whereas elevator cars L5, L6, L7 and L8 are single-door cars. There are passenger guidance devices PG1, PG2, PG3, PG4, PG5, PG6 placed outside the lobby areas on the transfer floor and beside elevator L3, in front of elevator L5 and between elevators L6 and L2. In addition, each elevator is provided with guidance means (not shown in the figure) to guide the passenger to the correct passenger guidance device PG1, PG2, PG3, PG4, PG5 and PG6. The lobbies are indicated by letters A, B and C and they are depicted with different line, dot or diamond patterns to distinguish different lobby areas from each other.

According to FIG. 3, the passenger arrives at the transfer floor by elevator L4, from which he is guided to the passenger guidance device PG1 placed outside lobby area C, which serves him this time and which tells him which elevator will take him further to the target floor. The passenger guidance device tells the passenger that elevator L5 has been allocated to the passenger having reached the transfer floor by elevator L4, and that elevator L5 will arrive at the transfer floor in 15 seconds. The passenger guidance device PG1 can also be used to show the passenger arriving on elevator L4 information regarding elevators going later to the passenger's target floor or to the next transfer floor. The other passenger guidance devices PG2 and PG3 placed outside the lobby areas A, B and C are of the same type as PG1 in their operating principle.

Passenger guidance device PG4 is placed right beside elevator L3 to inform only passengers arriving on or entering that elevator at the transfer floor. This passenger guidance device PG4 presents information e.g. about how long it will take for the elevator to reach the transfer floor and which is its latest departure floor. Likewise, this passenger guidance device PG4 can tell a passenger leaving the elevator which is the next elevator allocated to him and going either to the target floor or to the next transfer floor. It is also possible to inform the passenger leaving the elevator about elevators that will depart after the one allocated to him just in case the passenger should be delayed on the transfer floor. The passenger guidance device PG5 placed in front of elevator L5 presents via a display D3 information for the passenger coming from the elevator into lobby A. This passenger guidance device PG5 has preferably been arranged to guide the passenger in the direction of another passenger guidance device PG2.

Passenger guidance device PG6, which is disposed between elevators L6 and L2, comprises a display arrangement such that display D1 presents elevator change information for the passenger entering lobby A from elevator L6 and display D2 presents elevator change information for the passenger entering lobby A from elevator L2. This elevator change information presented on the displays D1 and D2 may be information guiding to some other passenger guidance device PG1, PG2 or PG3 outside the lobby. Another alternative is that the display D1 of passenger guidance device PG6 tells the passenger leaving elevator L6 which is the next elevator allocated to him and display D2 indicates to the passenger leaving elevator L2 the elevator allocated for him and going to the target floor or to the next transfer floor.

The above-mentioned passenger guidance devices PG1, PG2, PG3, PG4, PG5 and PG6 preferably refer to display means used to present elevator passengers information they need at the transfer floors when the passengers transfer from an elevator serving a given zone to an elevator serving another zone. In addition, the passenger guidance devices PG1, PG2, PG3, PG4, PG5 and PG6 can advantageously be disposed in conjunction with the destination floor call devices at the landing of the transfer floor.

The present invention is characterized by what is disclosed in the characterization part of claim 1. Other embodiments of the invention are characterized by what is disclosed in the other claims. Inventive embodiments are also presented in the description part of this application. The inventive content of the present application can also be defined in other ways than is done in the claims below. The inventive content may also consist of several separate inventions, especially if the invention is considered in the light of expressions or implicit sub-tasks or in view of advantages or sets of advantages achieved. In this case, some of the attributes contained in the claims below may be superfluous in respect of separate inventive concepts.

Moreover, the embodiments of the present invention are not necessarily limited to any one of the embodiments described above, but different embodiments can, within the framework of technical prerequisites, be combined in part or completely. Likewise, portions of different embodiments can be used to form embodiments not described here that are consistent with the basic concept of the invention.

The invention claimed is:

1. Method for controlling the elevators of an elevator group in a building divided into zones comprising different floors in such manner that, at the passenger's departure floor, the elevators are given calls to floors beyond the zone limits of the departure zone, characterized in that the aforesaid call is divided into at least two sub-calls in such manner that the passenger will travel through several zones and transfer floors to the destination floor so that the allocation of the latter portion of the trip is delayed as compared to the allocation of the first portion of the trip and that a change between elevators of the elevator group serving different zones is performed on a transfer floor which is selected in the group control of the elevator group from several predetermined transfer floors overlapping with one or more different zones by one or more floors.

2. Method according to claim 1, characterized in that the sub-call pertaining to the aforesaid latter portion of the trip is allocated later when the passenger on his/her trip is temporally close to a transfer floor, to be served by a later zone.

3. Method according to claim 1, characterized in that the sub-call for the aforesaid latter portion of the trip is allocated to the next transfer floor or, when the passenger is on the aforesaid transfer floor, to the destination floor.

4. Method according to claim 1, characterized in that the sub-call for the aforesaid latter portion of the trip is allocated to the next transfer floor or to the destination floor when the passenger comes temporally relatively close to the aforesaid next transfer floor as compared to the total travel time of the elevator allocated to the passenger at the departure floor or at the previous transfer floor.

5. Method according to claim 1, characterized in that the aforesaid transfer floor is selected in the group control system from among predetermined transfer floors on the basis of the load factor so that the number of passengers on the transfer floors is minimized.

6. Method according to claim 1, characterized in that the aforesaid transfer floor is selected in the group control system from among certain possible transfer floors by adaptively varying the number of transfer floors and/or the limits of the transfer floor zone on the basis of the load factor of each transfer floor.

7. Method according to claim 1, characterized in that the aforesaid call to a floor beyond the zone limits of the departure zone is divided into as many calls as the passenger has zones to pass through on his/her way from the departure floor to the destination floor in such manner that the first call is given from the departure floor to an intermediary transfer floor and a first car is allocated to the passenger and one or more of the next calls are given from the previous intermediary transfer floor to the next intermediary transfer floor and a car is al-located to the passenger so that the last call is given from the last intermediary transfer floor to the destination floor and a car is allocated to the passenger.

8. Method according to claim 1, characterized in that the aforesaid call to a floor beyond the zone limits of the departure zone is divided into two calls such that a first call is given from the departure floor to a transfer floor and a first car is allocated to the aforesaid passenger and a second call is given from the aforesaid transfer floor to the destination floor and the aforesaid passenger is allocated a second car to the destination floor.

9. Method according to claim 1, characterized in that the passenger is guided by means of car-specific and/or elevator-specific and/or lobby-specific passenger guidance devices on the transfer floor to elevators allocated from there to the destination floor or to intermediary transfer floors.

10. Method according to claim 1, characterized in that displays serving as passenger guidance devices are placed either in the upper part of the elevator car or in the elevator lobby in front of the elevator arriving at a transfer floor or outside the elevator lobby on the transfer floor.

11. Method according to claim 1, characterized in that the aforesaid transfer floor is selected in the elevator group control system during the travel of the elevator car allocated to the passenger from the departure floor.

12. Method according to claim 1, characterized in that the elevators in the building divided into zones are controlled in such manner that each zone is controlled as a separate elevator group by a separate group control system and the group control systems controlling each zone are controlled together by a coordinating elevator group management control system, which divides the aforesaid zone-specific elevator groups into classes.

13. Method according to claim 1, characterized in that the call to a floor beyond the zone limits of the departure zone given to the elevators of the elevator group on the departure floor is issued as a destination floor call by means of a destination call input device in the elevator lobby.

14. Method according to claim 1, characterized in that the call to a floor beyond the zone limits of the departure zone given to the elevators of the elevator group on the departure floor is issued as a hybrid call or car call beyond the zone.

15. Method according to claim 1, characterized in that when the elevators are given a call on the departure floor, a check is always carried out to determine whether the departure floor belongs to the same zone with the destination floor.

* * * * *